United States Patent [19]

Kruck et al.

[11] Patent Number: 4,959,111

[45] Date of Patent: Sep. 25, 1990

[54] HEAVY GAS-FILLED MULTILAYER INSULATION PANELS AND METHOD OF MANUFACTURE THEREOF

[75] Inventors: Richard W. Kruck, Sodus Township, Berrien County; Omer N. Cur, St. Joseph Township, Berrien County, both of Mich.

[73] Assignee: Whirlpool Corporation, Benton Harbor, Mich.

[21] Appl. No.: 267,330

[22] Filed: Nov. 4, 1988

Related U.S. Application Data

[62] Division of Ser. No. 897,978, Aug. 19, 1986, Pat. No. 4,808,457.

[51] Int. Cl.[5] ..... B32B 31/10; F25D 23/06

[52] U.S. Cl. ..... 156/145; 156/308.4; 156/285; 62/DIG. 13; 220/426; 428/69; 312/214

[58] Field of Search ..... 428/69, 71, 178; 156/292, 285, 308.4, 145, 213; 62/DIG. 13, 530; 250/DIG. 9, 422, 426; 312/214

[56] References Cited

U.S. PATENT DOCUMENTS

| | | | |
|---|---|---|---|
| 1,969,621 | 8/1934 | Munters | 428/69 |
| 1,973,880 | 9/1934 | Moody | 220/431 |
| 1,993,730 | 3/1935 | Carpenter | 220/428 |
| 2,034,138 | 3/1936 | Gould | 220/445 |
| 2,045,000 | 6/1936 | Smith | 62/DIG. 13 |
| 2,053,252 | 9/1936 | Cook et al. | 220/450 |
| 2,057,746 | 10/1936 | Schweller | 220/450 |
| 2,065,608 | 12/1936 | Munters | 220/5 R |
| 2,098,193 | 11/1937 | Munters | 428/69 |
| 2,162,271 | 6/1939 | Munters | 220/445 |
| 2,663,448 | 12/1953 | Spiegelhalter | 220/445 |
| 3,149,742 | 9/1964 | Hay et al. | 220/423 |
| 3,595,728 | 7/1971 | Robson | 220/426 |
| 3,882,637 | 5/1975 | Lindenschmidt | 52/615 X |
| 3,981,689 | 9/1976 | Trelease | 138/148 X |
| 4,043,624 | 8/1977 | Lindenschmidt | 52/631 X |
| 4,376,558 | 3/1983 | Bandar | 206/523 X |

*Primary Examiner*—Michael W. Ball
*Assistant Examiner*—Michele K. Yoder
*Attorney, Agent, or Firm*—Lowe, Price, LeBlanc, Becker & Shur

[57] ABSTRACT

A self-contained thermal insulation panel, of generally flat rectangular form suitable for placement within the walls or doors of a refrigeration cabinet, consists of a hermetically sealed envelope surrounding an assembled framework defining a plurality of thin parallel internal cavities. The cavities are formed by a plurality of thin stretched-out sheets, each preferably with at least one reflective face, spaced-apart by thin interlocking peripheral gaskets between a top and a bottom frame member. A method of manufacturing an insulation panel according to this invention requries the initial assembly, on a first frame member, of an alternating array of thin sheets and gaskets, then a final sheet and a second frame member all brought firmly together and permanently affixed as a unified assembly. The assembled structure is then evacuated and refilled with a heavier-than-air gas of low thermal conductivity, e.g., a halogenated methane or ethane, and sealed into an outer envelope closely surrounding the frame structure which thereby defines the panel shape. In another embodiment of the insulation panel, gas-filled foam around the edges of the thin strectched-out sheets replaces the well-defined framework to form the plurality of gas-filled cavities therebetween. In yet another embodiment, gas-filled bubbles formed on one side of each sheet space it from the adjacent sheet, without a framework or foam, to generate the cavities.

7 Claims, 6 Drawing Sheets

HEAVY GAS-FILLED MULTILAYER INSULATION PANELS AND METHOD OF MANUFACTURE THEREOF

This is a division, of application Ser. No. 06,897,978, filed Aug. 19, 1986, now U.S. Pat. No. 4,808,457.

TECHNICAL FIELD

This invention relates generally to thermal insulation panels suitable for placement in substantially flat hollow walls and doors of low temperature containment chambers such as refrigerators and freezers and, more particularly, to such thermal insulation panels employing a heavier-than-air gas hermetically sealed into a plurality of high aspect-ratio, reflectively-walled cavities.

BACKGROUND OF THE INVENTION

High energy costs have resulted in concerted efforts by industry to produce goods that reduce energy waste, e.g., by producing high-mileage automobiles, more effective home insulation, and more cost-effective home appliances. Competitive market pressures now require that products be energy-efficient and that consumers be provided with numerical data by which the public may compare competing products, e.g., estimated average operating costs in "dollars per year" for home appliances such as refrigerators and freezers.

Naturally, while the public will favor energy efficient products, the manufacturing and sales price of any product must not be unreasonably high. The focus, therefore, has to be on how to manufacture products at the lowest possible cost and with good performance characteristics. In the manufacture of refrigerators and freezers, consequently, improvements are sought for low cost, highly effective, easy-to-handle insulation panels for location inside the hollow walls of cooled chambers to reduce heat transfer losses therethrough.

Since heat transfer takes place by conduction, radiation and convection, an insulation panel must efficiently reduce all three modes of heat transfer. It is known that a highly effective parallel-sided insulation panel can be created, in which heavier-than-air gas filled narrow cavities are formed by a series of thin reflective sheets. For example, in U.S. Pat. No. 1,969,621 to Munters (Munters I) a hermetically sealed casing including sidewalls made of aluminum, iron, or other gas-tight substance contains a plurality of thin sheet members made of aluminum foil or the like separated by cardboard frames. The interior of the sealed panel is filled with a gas having a lower coefficient of heat conductivity than air at a corresponding pressure and temperature. Heavy gases recommended in Munters I include methylchloride ($CH_3Cl$), dichloroldifluoromethane ($CCl_2F_2$), and methylbromide ($CH_3Br$), and the distance between adjacent partitions or foils is recommended to be less than 5 mm. to prevent convection currents in the gas. The gas may be introduced into the panel by evacuating and filling the insulation casing while the casing is wholly contained in a pressure vessel, so that the pressure inside and outside the insulation casing can be maintained the same. Endwalls are made of a material of low heat conductive capacity, e.g. celluloid or the like or a nickel-iron alloy, with the walls pasted on with a polymeric vinyl acetate.

U.S. Pat. Nos. 2,065,608 and 2,162,271, both also issued to Munters and describing a similar insulation panel, disclose that convection currents between adjacent gas layers must be prevented to obtain effective insulation across the entire assembly, and that spacing between adjacent foil members defining the cavities should be approximately 4 mm.

Conduction heat transfer through solid materials is limited to the periphery of the panel. Radiation heat transfer across the panel is minimized by the introduction of multiple reflective layers, with the effectiveness being increased by the number of reflective sheets in the assembly and by making both sides of each sheet reflective. If an enclosed gas space can be made thin enough, essentially only a conductive heat transfer mode through the thin gas layer is established. Ideally, the gas spaces should be of uniform thickness bounded by plain, smooth, parallel and preferably high reflective surfaces with no leakage of gas into or from the enclosure. Experimental evidence supports the belief that the use of heavy molecular gasses, such as those suggested in Munters I, leads to an effective insulating value of the order of 0.06 Btu-in/hr-ft$^2$-°F. at room temperatures.

No free-convection currents occur in a fluid which is enclosed between two parallel horizontal plates so long as the temperature of the upper plate is higher than the temperature of the lower one, so that the heat transfer takes place only by conduction across the heavy gas layer.

The situation is different when a fluid is enclosed between two horizontal surfaces of which the upper surface is cooler than the lower one. Since the heat transfer now occurs from the lower toward the upper surface, the fluid between the two surfaces assumes such tempertures that the colder fluid layer is situated above the warmer one. For a gas whose density decreases with increasing temperature this leads to an unstable situation, but does not give rise to convection currents so long as the Rayleigh Number is below 1700.

For vertical fluid layers, the fluid rotates slowly at low values of Reynolds number, moving upward along the heated surface and downward along the cooled surface. At sufficiently low Rayleigh numbers, the streamlines are parallel to the vertical surfaces over the major portion of the fluid layer and are closed near the upper and lower ends. Thus the heat transfer in the central portion of the fluid is essentially by conduction only. In principle, therefore, so long as the Rayleigh number is below 1700, the heat transport across the gas-filled thin cavity becomes independent of orientation and takes place essentially by conduction across only the heavy gas. Hence insultation panels containing such cavities are effective vertically or horizontally and at the top or bottom of an insulated chamber, provided the Rayleigh Number is kept below 1700.

The Rayleigh number is defined as:

$$Ra = GrPr = C_p g \beta (T_H - T_c) \rho^{2\delta 3} / k\mu$$

where

Gr: Grashof number

Pr: Prandtl number $\rho$: fluid density (lbm/ft$^3$)

$\beta$: expansion coefficient (°F.$^{-1}$)

$C_p$: specific heat k: thermal conductivity of the fluid (Btu/hr-ft-°F.)

$\mu$: fluid viscosity (lbm/ft-hr)

$T_H$, $T_C$: hot and cold surface temperatures (°F.)

$\delta$: fluid layer thickness (ft).

It is clear from the preceding that given a particular insulation problem, with specific high and low temperatures $T_H$ and $T_C$, the designer may select a gas having suitable natural properties $C_p$, $\rho$, $\beta$, $\mu$ and k and may also select the fluid layer thickness to obtain the desired essentially conductive flow through the heavy gas by ensuring a Rayleigh Number less than 1700.

Although the theory is well understood, a full realization of the expected benefits thereof requires the developement of a practical manufacturing method for producing such multi-cavity, gas-filled insulation panels.

DISCLOSURE OF THE INVENTION

Accordingly, it is an object of this invention to provide in a refrigeration cabinet a thermal insulation panel having improved thermal insulation properties.

It is another object of this invention to provide a self-contained thermal insulation panel, having a thickness substantially smaller than its lateral dimensions and containing a plurality of gas-filled, thin, transversely extensive cavities separated by a plurality of substantially parallel thin sheets inside a hermetically sealed outer envelope.

It is a further object of this invention to provide a hermetically sealed, self-contained, gas-filled thermal insulation panel having an internal frame structure to locate and support a plurality of parallel thin sheets to produce a substantially non-communicating plurality of thin gas-filled adjacent cavities.

It is an even further object of this invention to provide a self-contained, hermetically sealed, gas-filled thermal insulation panel in which a plurality of thin reflectively coated sheets are disposed close and parallel to each other to form thin gas-filled cavities across which heat transfer takes place primarily by conduction through a heavier-than-air, low thermal conductivity gas, such as a halogenated methane or an ethane compound.

It is yet another object of this invention to provide a method for manufacturing a hermetically sealed, self-contained, gas-filled thermal insulation panel in which a separately assembled internal structure is evacuated of air and filled with a selected gas into a hermetically sealed outside envelope at atmospheric pressure and temperature.

It is yet another object of this invention to provide an improved method for manufacturing a hermetically sealed self-contained thermal insulation panel having a plurality of thin, transversely extensive, gas-filled cavities within.

It is another object to this invention to provide a manufacturing method for producing a hermetically sealed, self-contained, gas-filled thermal insulation panel containing an internal framework which defines the shape and size thereof while locating and supporting a plurality of closely spaced-apart thin sheets to form a plurality of gas-filled thin cavities within the panel.

It is still another object of this invention to provide an inexpensive easy-to-manufacture, self-contained, hermetically sealed, gas-filled thermal insulation panel in which an internal skeletal framework and gaskets made of injection-molded plastic material locate and retain a plurality of closely spaced-apart, parallel, thin, reflective sheets to generate a plurality of substantially non-communicating gas-filled cavities across which heat transfer takes place primarily by conduction.

These and other objects of this invention in a preferred embodiment are realized by providing two similarly shaped and sized, essentially skeletal, frame members which define the outer transverse shape and size of a completed panel, with frame-separating elements substantially normal to the transverse expanse of the frame members for maintaining the same parallel and spaced-apart. The frame members, when assembled together, define an interior space therebetween and establish the thickness of the finished panel. A plurality of thin sheets of a thermally insulating material is provided between the frame members, located and supported to be parallel to each other and to both the frame members. Substantially peripheral gaskets peripherally stretch and separate the thin sheets from each other, and the entire assembly so formed is closely enveloped by an outside hermetically sealed envelope filled with a selected gas having a low thermal conductivity.

A preferred method for manufacturing such a thermal insulation panel includes assembling on a first frame member a succession of thin sheets, each provided with at least one reflective surface and separated by gaskets. A second similarly shaped and sized frame member is positioned on the first to retain the plurality of sheets and gaskets between them. The cavities formed between successive sheets within the assembly are evacuated and then refilled with a heavier-than-air, low thermal conductivity gas. The assembled gas-filled structure is finally hermetically sealed within an outside envelope.

Still other objects and advantages of the present invention will become readily apparent to those skilled in this art from the following detailed description, wherein only the preferred embodiment of the invention is shown, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

Figure 11:
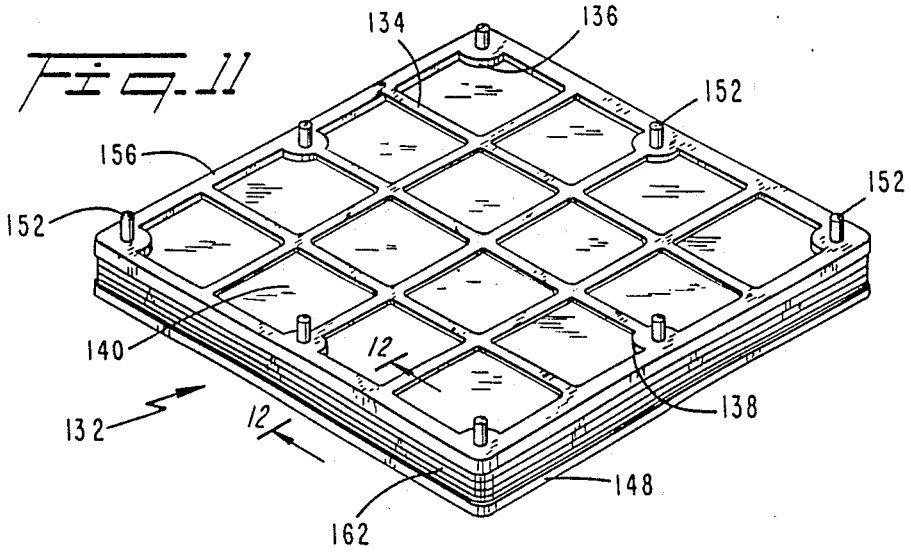

FIG. 11 is a perspective view of the internal framed assembly of a second preferred embodiment of the insulation panel at an intermediate stage in its assembly.

Figure 12:
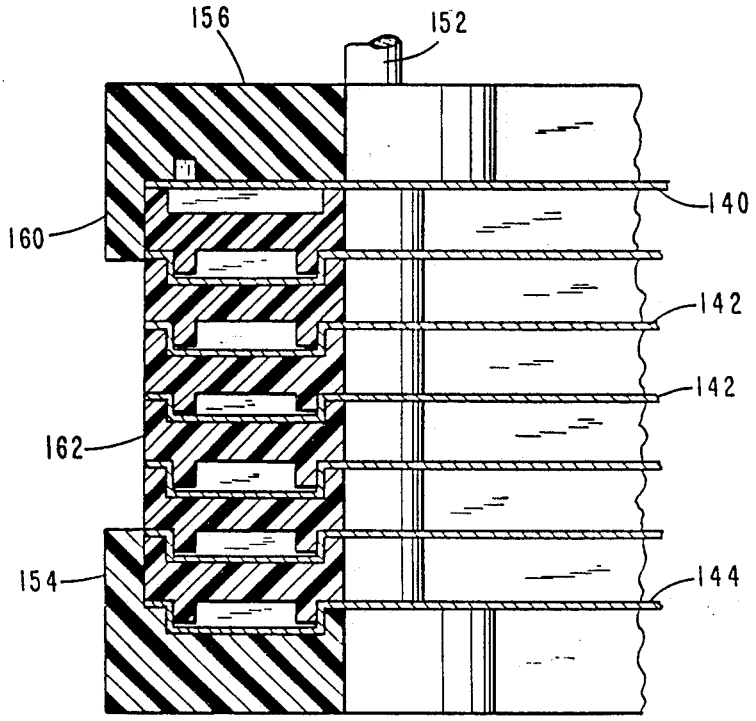

FIG. 12 is a partial vertical cross-sectional view of the internal framed structure, at section 12—12 of the assembly of FIG. 11, in its final assembled form.

DETAILED DESCRIPTION OF THE PREFERRED EMBODIMENTS

Figure 1:
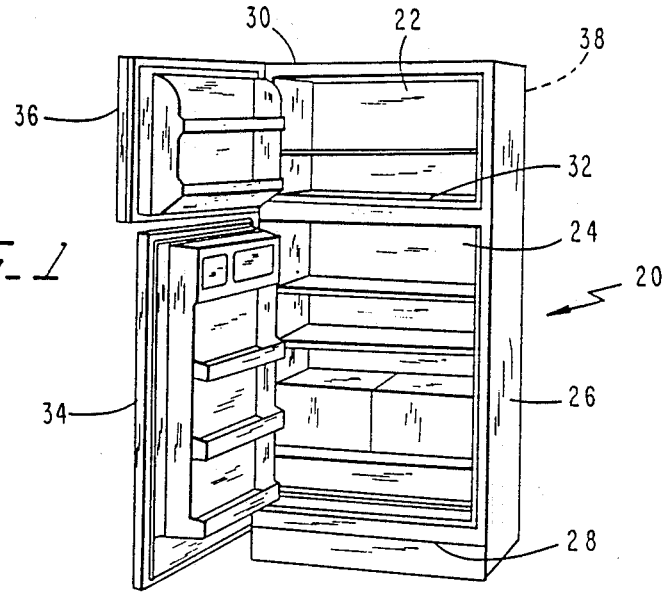
FIG. 1 is a perspective view of a typical refrigerator and freezer combination unit, with its doors open to expose the interior panels of the refrigerator cabinet.

A typical refrigerator-freezer combination unit 20, as best seen in FIG. 1, has a generally vertical cubical cabinet, with a freezer compartment 22 located above a refrigeration compartment 24. The appliance has two similar vertical side walls 26, a bottom wall 28, a top wall 30, a divider 32 between the freezer and refrigeration compartments 22 and 24 respectively, and refrigerator door 34 and freezer door 36, both typically hinged about vertical hinges on one side. The unit also generally has a large rectangular vertical back wall 38. The outside casing of the appliance and of both the freezer and refrigerator doors typically are made of painted steel. The inside surfaces of both the freezer and the refrigerator compartments 22 and 24, as well as the inside portions of the refrigerator and freezer doors 34 and 36 respectively, are generally made of an easy-to-clean, smooth, molded plastic material. During manufacture of the unit, insulation panels are placed between the metal casing and door units, and inner plastic liner members are inserted and sealed into place thereafter. Sealing elements or gaskets may be provided around the peripheries of both the freezer and refrigerator doors during this process. Because of the generally rectangular configuration of the walls and doors of such units, it is most efficient and practical to design the insulation panels to have generally flat rectangular forms.

Figure 2:
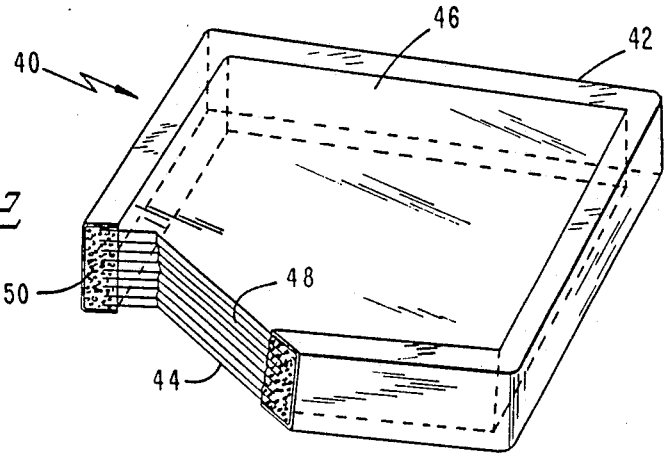
FIG. 2 is a partially cut-away perspective view of a multi-cavity gas-filled insulation panel, according to this invention.

The insulation panel 40 shown in FIG. 2 comprises a peripheral casing 42, bottom and top outside gas impermeable sheets 44 and 46 respectively, and a plurality of internal sheets 48 peripherally spaced-apart, separated, and sealed by foam-like material 50. Although the panel 40 is very effective, it is difficult to assemble in a high-volume manufacturing operation, even with conventional foam-disposing techniques, due in part to the initially semi-liquid, sticky sealant foam 50 that supports and separates the sheets 44 and 48. Heavier-than-air gases, comparable to the gas disposed between sheets 48, can be utilized in the forming process of delivering and providing foam 50. The manufacturing process, comprised of conventional steps involving delivery, disposition, and subsequent curing of the foam in place while sealing in the heavier-than-air gas within tends to be both slow and expensive.

Figure 3:
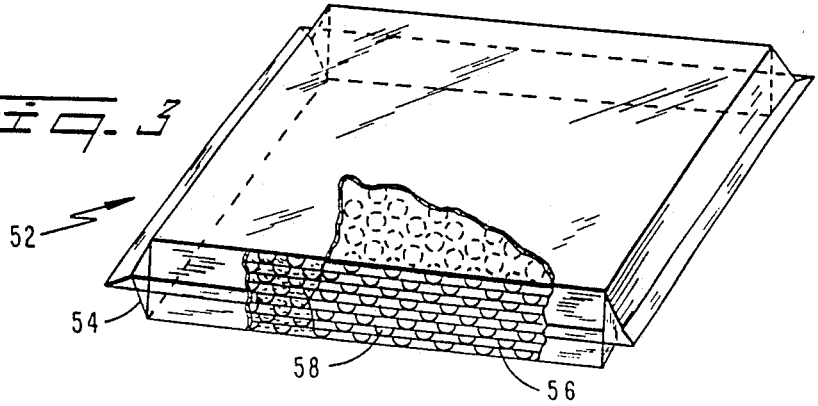
FIG. 3 is a partially cut-away perspective view of a hermetically sealed insulation panel containing a plurality of sealed-bubble membranes within, according to one aspect of this invention.

An alternative solution, as best seen in FIG. 3, comprises an insulation panel 52 in which an envelope 54 closely surrounds a plurality of sheets 56 each formed on a side with gas-filled bubbles 58. Such sheets are often used to package delicate items during transportation. The conventional process for forming such sheets can be readily adapted to fill the bubbles with a heavier-than-air gas of the type discussed hereinafter for filling of the cavities between adjacent sheets. Bubbles 58, by local contact at their tops, serve to space apart the individual sheets 56, preferably provided with reflective coating on their flat or unbubbled sides, and the insulation panel is relatively light and easy to handle. A low thermal conductivity, heavier-than-air, gas is used to fill in the spaces between the sheets before the gas-impermeable envelope 54 is sealed. Although generally satisfactory, such an internal configuration with bubbles does not in practice permit a full realization of the benefits obtainable from a plurality of uniformly thin, heavy gas-filled regions in a geometrically well-defined insulation panel.

Figure 4:
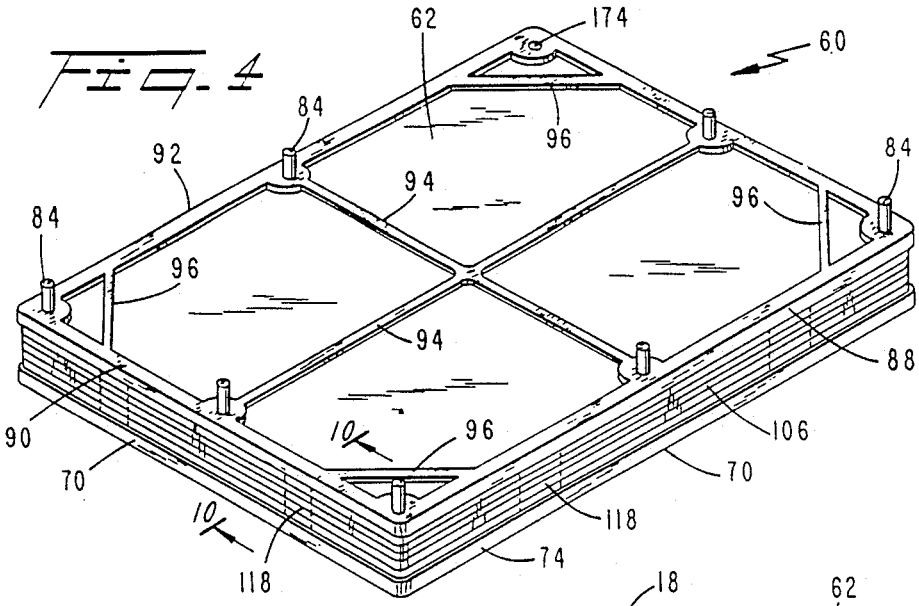
FIG. 4 is a perspective view of the internal framed structure of a preferred embodiment of this invention at an intermediate stage in its assembly.

Careful analysis of such problems and considerable experimental research has led to the present invention which employs a geometrically well-defined internal framed assembly 60, as best seen in FIG. 4, inside an outer hermetically sealed envelope (not shown for simplicity) but generally similar to envelope 54 in FIG. 3. This internal framed assembly 60 comprises various elements best understood with reference to FIGS. 5–10, as more fully discussed hereinafter. Stated briefly, the internal framed assembly 60 consists of a first frame member 70, a second frame member 88 engaged with and eventually affixed to extensions of frame member 70 and, between the frame members, a plurality of interlocking peripheral gaskets 106 separating plurality of thin sheets 62, 64 and 66 to define thin cavities therebetween.

Figure 5:
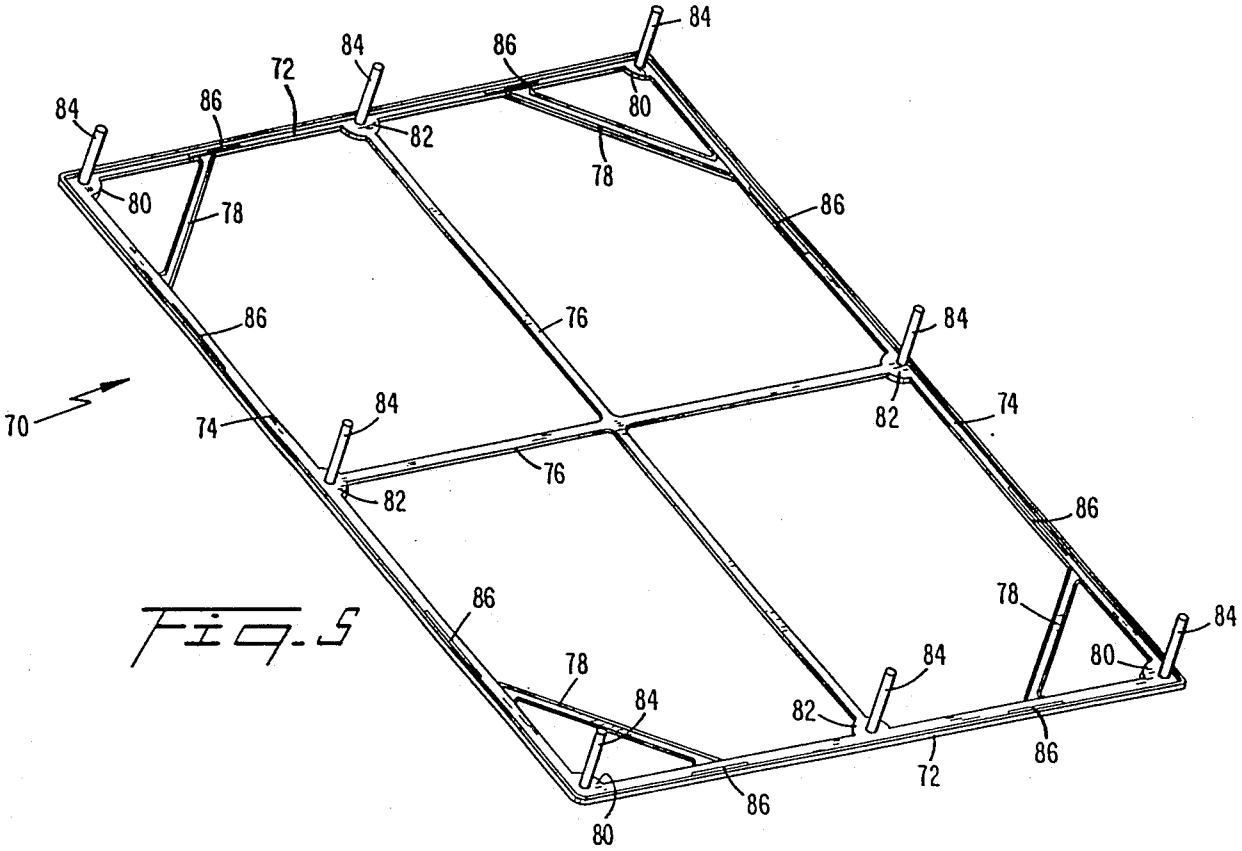
FIG. 5 is a perspective view of the lower frame member of the assembly of FIG. 4.

In more detail, the internal frame structure 60 of the preferred embodiment of the present invention begins with first frame member 70, best seen in FIG. 5 as having a generally rectangular shape and size that essentially defines the final shape and size of the finished insulation panel. As persons skilled in the art will readily appreciate, the material used to manufacture this and other similar coacting elements should have a relatively low thermal conductivity and be light and inexpensive to manufacture. Such elements are most conveniently made of injection-molded plastics material.

Framed member 70 preferably has two parallel short straight sides 72 and two parallel long straight sides 74 orthogonal to sides 72. A generally X-shaped strengthening brace 76 with four arms is preferably cast integral with the outer sides 72 and 74. Likewise, to strengthen the corners during handling in the manufacturing process and thereafter, corner braces 78 are provided at the four corners. Extra material is provided to form bases 80 at each of the four corners and bases 82 at the ends of the cross-bracing 76.

At each of these bases 80 at each of the four corners and the bases 82 at the four ends of the cross bracing 76, parallel, thin, cylindrical, pin-like extensions 84 are provided orthogonal to the plane of the frame member 70. Extensions 84 may conveniently be formed with tapered or rounded ends for ease of assembly with other elements.

Portions 86, of the short sides 72 and the long sides 74 respectively, are formed to provide an interlocking assembly with a matching gasket forcibly pressed thereto. The geometry of such interlocking portions 86 is discussed more fully with reference to other figures hereinafter.

Figure 6:
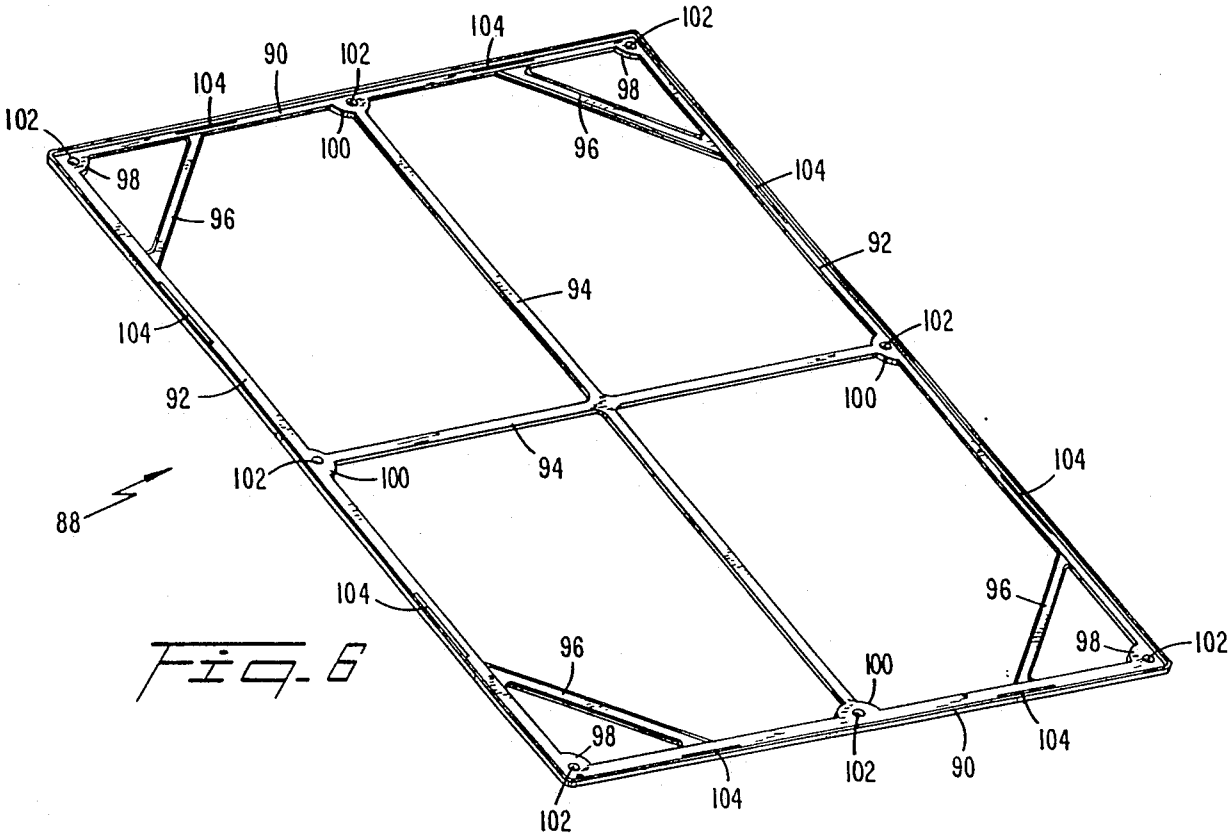
FIG. 6 is a perspective view of the upper frame member of the assembly of FIG. 4.

The upper frame member 88, of the same outer shape and size as the lower frame member 70, is best seen in FIG. 6. Frame member 88 has two parallel short sides 90 and two parallel long sides 92 orthogonal to sides 90. A generally X-shaped strengthening brace 94 is provided in a manner and disposition comparable to that of strengthening cross-brace 76 in lower frame member 70. Likewise, corner bracing 96 is provided to strengthen the corners during manufacturing and subsequent handling. Additional material is provided at each corner to form bases 98 and at the ends of central cross bracing 94 to form bases 100. Through apertures 102 are provided at each of bases 98 and 100 to match the dispositions of pins 84 of the lower frame member 70. Apertures 102 are also sized to provide a frictional fit around pins 84 when these are pushed therethrough. Portions 104 of short sides 90 and long sides 92 are provided in a form and disposition to match and interlock with portions of a peripheral gasket 106 to be described below.

Figure 7:
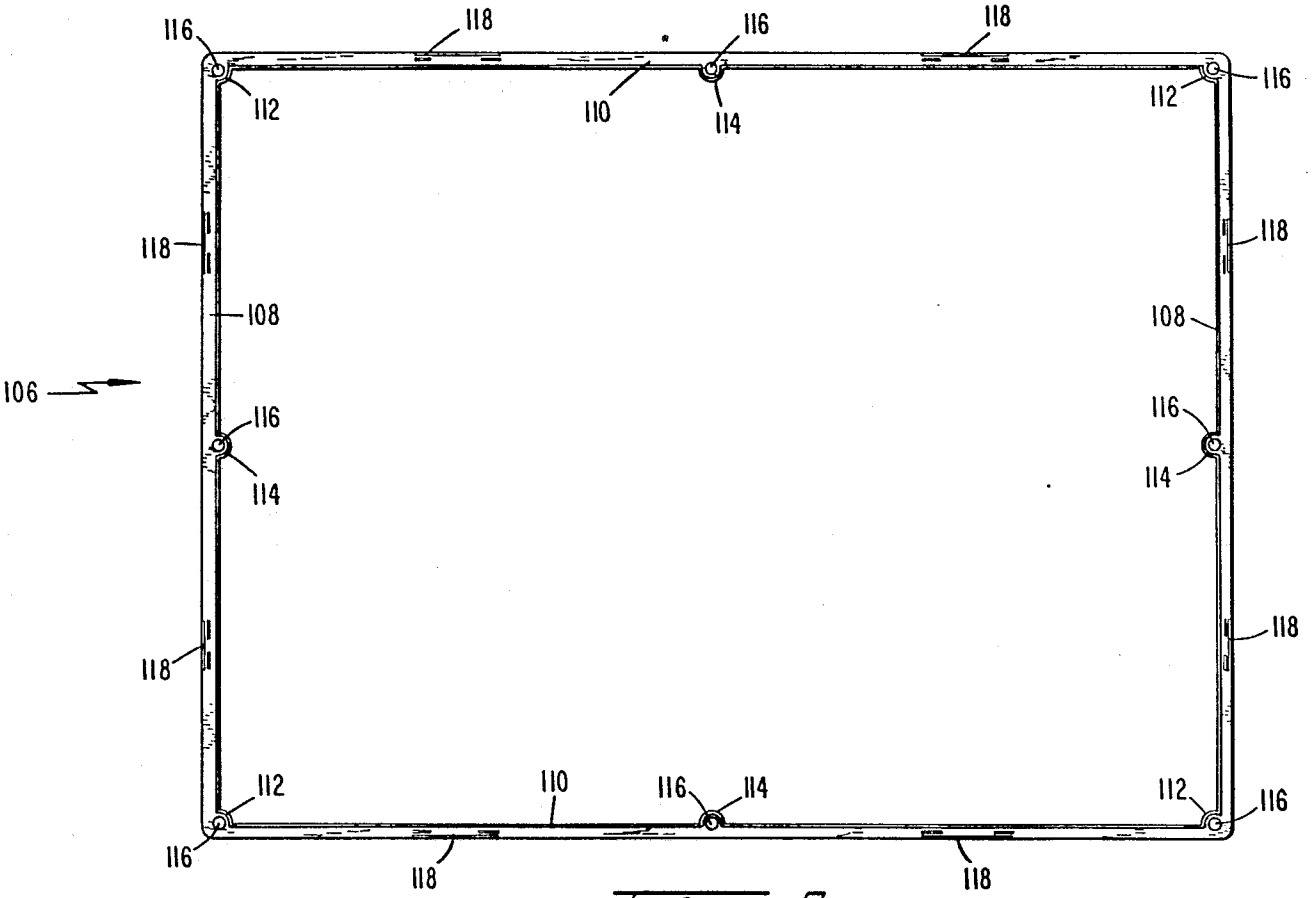
FIG. 7 is a plan view of a typical gasket of the assembly of FIG. 4.

As indicated in FIG. 4, a plurality of thin sheets such as top sheet 62 are employed to create thin gas-filled cavities within the insulation panel. According to this invention, such thin sheets are best separated at their peripheries by gaskets 106 while supported by pins 84 of lower frame member 70. As best seen in FIG. 7, a typical gasket 106 has two short parallel opposite sides 108 orthogonal to two relatively long parallel opposing sides 110 to have a generally rectangular disposition comparable in shape and size to those of lower frame member 70 and upper frame member 88. Bases 112 are provided at each of the four corners of gasket 106 and bases 114 are provided at the midportions of sides 108, 110 to match the dispositions of pins 84 of lower frame member 70. Apertures 116 are provided in each corner base 112 and each side base 114, sized to fit around pins 84 of frame member 70 pushed therethrough. Portions 118 of short sides 108 and long sides 110 are formed to permit forcible interlocking engagement of adjacent gaskets with each other and with either one of lower frame member 70 or upper frame member 88 when adjacent thereto.

This interlocking of adjacent gaskets, with each other or with their lower or upper frame members as the case may be, strengthens the sides by uniting individually rather weak gaskets and frame members into a stronger composite capable of resisting considerable stress both during manufacturing and in subsequent handling, and also serves the purpose of stretching out individual sheets 62, 64, or 66 (as the case may be) in the final assembly. This stretching out of the sheets is extremely important, as it ensures close parallel spacing of the sheets to form a plurality of thin, smooth-walled, gas-filled cavities in the final assembly.

Figure 10:
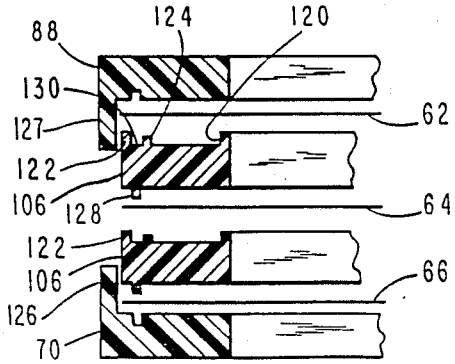
FIG. 10 is a partial vertical cross-sectional view of a portion of the assembly of FIG. 4, at section 10—10 prior to forcible interlocking assembly of adjacent gaskets with each other and with the lower frame member.

The flexible sheets, preferably of a strong material like Mylar (TM), and preferably aluminized or otherwise provided with at least one highly reflective surface, are cut to be of a shape and size to match the outside shape and size of gasket 106 with a slight amount of excess material around the perimeter and are provided with reinforced through apertures of a shape and size to match those of aperture 116 through gasket 106. The lowest such sheet, identified as 66 in FIG. 10, is the one closest to lower frame member 70. As best seen in FIG. 4, the uppermost such sheet is identified as 62 and is the one closest to upper frame member 88. Intermediate sheets 64 are provided in a number one fewer than the final number of cavities to be formed between adjacent sheets.

Figure 8:
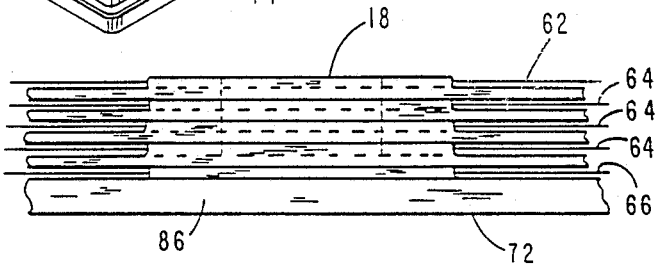
FIG. 8 is a partial side elevation view of the assembly of FIG. 4, showing the interlocking portions of adjacent gaskets and the lower frame member.
Figure 9:
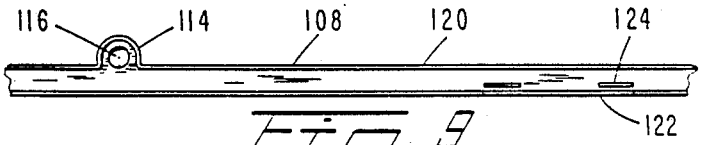
FIG. 9 is a partial plan view of a portion of an interlocking gasket of the type used in the assembly of FIG. 4.

During assembly of the internal frame assembly 60, the lowest sheet 66 is assembled with lower frame member 70 by pushing the respective pins 84 through apertures around the periphery of the sheet. Sheet 66 then is relatively firmly stretched out by pins 84 to be in close contact with an inner face of lower frame member 70. Contact between the lowest sheet and lower frame member 70 is therefore possible around the periphery and the reinforcement braces 94 and 96. A gasket 106 is then assembled with lower frame member 70 by the pushing through of respective pins 84 through apertures 116 of gasket 106. A second sheet 64 is then assembled over the pins 84 of lower frame member 70, followed by a second gasket 106 as before. As best seen in FIG. 8, this leads to an alternating array of gaskets 106 (of which a portion 118 of side 108 is seen in FIG. 8) and a plurality of sheets 64.

Because the ultimate gas-filled cavities are intended to be very thin, typically of the order of ⅛th in. and because such panels may be relatively large, sides 108 and 110 of gasket 106 are preferably provided with an internal strengthening rim 120 which follows the internal contour of gasket 106. Also, as best seen with reference to FIGS. 8, 9 and 10, the interlocking portion 118 of gasket 106 consists of a raised outer portion 122, with short parallel internal upward extensions 124 leaving a small trough 130 therebetween. At the underside of the gasket is provided a short outward extension 128 to match the shape and size of trough 130 therebelow. The intended result of this geometry, as best seen in cross-section in FIG. 10, is to ensure that when a force is applied to interlockingly engage neighboring gaskets (or a gasket with lower frame member wall 72 or upper frame member 88) a thin sheet 64 or 66 (as the case may be) is tightly gripped between extension 128 and trough 130 and is thereby firmly stretched across the assembly. Thus the application of external force in the direction of pins 84 causes interlocking engagement of the entire assembly 60 so that individual thin sheets 62, 64 and 66 of reflectively coated material are stretched across and locked in place between adjacent gaskets and the internal surfaces of lower frame member 70 and upper frame member 88.

The rim 120 around two of the bases 114 of gaskets 106 was eliminated to provide a small opening into each cavity so that, even after the entire assembly is squeezed tight together, it will be relatively easy to evacuate the cavity between neighboring sheets and to introduce a heavier-than-air gas within those cavities. These small openings do not cause gross infiltration of gas to degrade performance.

When a sufficient number of sheets, ending with the topmost sheet 62, have been so assembled, upper frame member 88 is engaged to pins 84 of lower frame member 70. The entire assembly is then squeezed together, and superfluous portions of pins 84 extending through upper frame member 88 are then trimmed off and the ends of trimmed pins 84 are heat-welded to upper frame member 88. The heat-weld 174, as best seen in FIG. 4, is preferably flush with the top surface of upper frame member 88. This completes assembly of the internal structure of the insulation panel. The assembly is now placed in a chamber, evacuated of air, refilled with a suitable heavier-than-air gas, and introduced into a closely fitting outer envelope which is provided with an internal layer of heat fusible material which can be heat-sealed to form a hermetically sealed completed insulation panel.

The outermost edge of lower frame member 70 may be provided with a strengthening and containing rim 126 as best seen in FIG. 10. A similar rim 127 may also be provided for upper member 88. The provision of such rims will ensure that the envelope surrounding the internal structure is firmly supported from within.

With reference now to FIG. 11, when an insulation panel 132 has to be made relatively large, it may be necessary to provide a more extensive cross bracing 134. When this is done, it may be possible to eliminate corner bracing in both the upper and lower frame members 156 and 148 respectively. Also, the assembly of FIG. 11 has a somewhat modified form of interlocking means between gaskets themselves and between gaskets and the upper and lower frames. Other than this, the essential internal structure for large and small insulation panels according to this invention is essentially the same. As best seen in FIG. 12, when the internal structure is fully assembled and the surplus portions of pin-like elements 152 are trimmed off and sealed to the top frame member 156, the final assembly has interlocking gaskets between the upper and lower frame members holding and stretching out a series of parallel, smooth-sided, preferably reflectively coated, spaced-apart sheets 140, 142 (as many as needed) and 144. The total number of cavities so formed, as persons skilled in the art will appreciate, will be one fewer than the total number of thin sheets so assembled.

For convenience, the method of assembling an insulation panel according to this invention may be summarized as follows with reference to FIGS. 4–8:

Step 1. Assemble the lowermost thin sheet 66 to the lower frame member 70 by insertion of the pin-like extensions 84 of the latter through apertures provided to receive the same in the thin sheet.

Step 2. Assemble a gasket 106 to the lower frame member 70 by insertion of the pin-like extensions 84 of the lower frame member through apertures 116 provided to receive the same in the gasket 106.

Step 3. Repeat the preceding two steps until the required number of sheets and gaskets have been assembled on the pins of the lower frame member 70.

Step 4. Assemble the topmost thin sheet 66 to the lower frame member 70 by the insertion of the pin-like extensions 84 of the latter through apertures provided to receive the same in the thin sheet.

Step 5. Assemble the upper frame member 88 to the lower frame member 70 by the insertion of the pin-like extensions 84 of the lower frame member through apertures 102 provided in the upper frame member 88 to receive the same.

Step 6. Apply a force on direction parallel to the pin-like extensions 84 of the lower frame member 70 to interlockingly engage all gaskets 106 interposed between the upper and lower frame members 70 and 88, respectively, to the same and to each other. This will also stretch out all the thin sheets 62, 64 and 66.

Step 7. Trim off surplus portions of the pin-like extensions 84 of the lower frame member 70, and e.g., by conventional heat-welding, affix the trimmed ends of said pin-like extensions 84 to the upper frame member 88.

Step 8. Place the assembly 60 thus formed into a chamber which is then evacuated of air.

Step 9. Introduce a selected, heavier-than-air gas having a low thermal conductivity into the chamber, at atmospheric pressure and temperature, to fill in the cavities formed between adjacent sheets of the assembled structure.

Step 10. Still within the gas-filled chamber, hermetically seal a close-fitting gas impermeable envelope around the assembled structure 60 to seal in the selected gas within. The manufacture of the insulated panel according to this invention is thus completed.

Insulation panels produced according to the above-described method may be "foamed in place" inside the hollow walls and partitions of a refrigerator or freezer structure in the conventional manner. It is desirable that these insulation panels occupy as much as possible of the available volume to maximize the thermal insulation benefits.

It should be appreciated that sealing in the envelope to have a preselected gas at approximately atmospheric pressure and temperature reduces any tendency for the envelope to burst open due to either a buildup or drop in ambient pressure. In fact when such a panel is used adjacent to a cooled chamber, e.g., a refrigerator or freezer, the cooling of the gas within the envelope will have a tendency to reduce the gas pressure to slightly below that of the ambient atmosphere. However, because the individual sheets are held stretched out by the interlocking gaskets and the frame members, there should be no significant deformation of the insulation panel in place.

Likewise, during the transportation of such panels through regions where the ambient temperature drops considerably in the winter or rises significantly during the summer, the provision of a framed internal structure considerably enhances the physical integrity of the insulation panel.

Finally, as persons skilled in the art will also appreciate, the gas selected to fill the insulation panel must be one which will not condense at the lowest temperatures likely to be encountered during used by the insulation panel. If this were to happen, the panel would lose effectiveness and may suffer structural damage as well.

Clearly, the present invention may be utilized to form insulation panels of other flat shapes, e.g., circular, semi-circular, triangular, or trapezoidal, as best suited for particular applications. Likewise, the methods of assembling, filling with gas, and sealing the insulation panels according to this invention are amenable to modification and changes well within the grasp of persons skilled in the art.

Insulation panels as disclosed herein have been analyzed in context with well understood principles of heat transfer and are experimentally found to provide excellent heat insulation characteristics. Thus, experimental results indicate a k-factor as low as 0.075 Btu-in/hr-ft$^2$-°F. for Freon-12, 0.06 Btu-in/hr-ft$^2$-°F. for Freon-12Bl, and 0.115 Btu-in/hr-ft$^2$-°F. for $CO_2$ gases. Experiments also indicate that bromochlorodifluoromethane ($CBrClF_2$) is particularly well suited for refrigeration temperatures above 20° F. and that the best insulation effect is obtained with iodotrifluoromethand ($CF_3I$). For most general uses where temperatures below freezing are likely to be encountered, however, bromotrifluoromethane ($CBrF_3$) is probably the best heavy gas to use in insulation panels formed according to this invention. Gas-filled cavities ⅛ in. thick and filled with such gases have been found to provide effective thermal conductivity values within about 10% of those for still gas.

Although the bulk of the preceding disclosure has been directed at describing the embodiment that utilizes coacting frame elements and sheets separated by peripheral gaskets, it should be understood that the embodiments of FIGS. 2 and 3, i.e., those employing gas-filled-foam-separated sheets and bubble-separated sheets, respectively, are considered to be within the scope of this invention. The same theoretical basis, overall shape and size considerations, choice of materials for the sheets, envelopes and reflective coatings, and selection of gases to fill their respective thin transverse cavities, apply (with apparent differences) equally to each embodiment of the invention disclosed herein.

It should, therefore, be apparent from the preceding that this invention may be practiced otherwise than as specifically described and disclosed herein. Hence modifications may be made to the specific embodiments disclosed herein, especially as to shape, size and the gases selected, without departing from the scope of this invention, and such variations are intended to be included within the claims appended below.

What is claimed is:

1. A method of manufacturing a self-contained, gas-filled, thermal insulation panel which is characterized by having a first transverse frame member with a plurality of orthogonal extensions on one side thereof for locating and retaining an alternating succession of parallel thin sheets each provided with sheet apertures disposed in correspondence with said extensions and interlocking peripheral gaskets each provided with gasket apertures in correspondence with the sheet apertures to form thin transversely extensive gas-filled cavities, and a second transverse frame member provided with frame apertures disposed in correspondence with said extension of the first frame member and thus affixable to the extensions, with the framed assembly thus formed being contained in a hermetically sealed envelope forming the outer skin of the panel, comprising the steps of:

locating a first thin sheet by receiving said extensions of said first transverse member through said sheet apertures of the first thin sheet for location and stretched out retention of the first thin sheet thereby on said first transverse frame member;

locating a gasket on said first thin sheet for retention on said first transverse frame member with said extensions received through the gasket apertures, and applying a force to said gasket to interlock said first gasket with said first frame member to firmly grip and securely stretch said first thin sheet therebetween;

repeating the preceding two steps for locating successive thin sheets and interlocking successive gaskets each with a previously located gasket, until a desired number of unsealed cavities thus formed between adjacent thin sheets is obtained;

locating said second frame member by receiving said extensions through said frame apertures, in interlocking relationship with the last located gasket therebelow to firmly grip the last located thin sheet thereon;

affixing said second frame member to said received orthogonal extensions of said first frame member to form said framed assembly;

filling said cavities with a heavier-than-air gas; and enveloping said framed assembly in a hermetically sealed envelope to retain said gas within said cavities.

2. A method of manufacturing an insulation panel according to claim 1, wherein:

said step of affixing said second frame member to said orthogonal extensions of said first frame member comprises the further steps of trimming off any excess portions of said extensions extending past said second frame, and hot-welding said trimmed portions of said extensions to said second frame member.

3. A method of manufacturing an insulation panel according to claim 1, wherein:

said step of filling said cavities with said gas comprises the further steps of placing the framed assembly of first and second frame members with said gaskets and said thin sheets forming a plurality of unsealed cavities therebetween in a space that can be substantially evacuated of air, substantially evacuating said space and said unsealed cavities of air, and filling in said space and cavities with said gas.

4. A method of manufacturing an insulation panel according to claim 1, wherein:

said step of enveloping said framed assembly takes place inside said space while said space is filled with said gas.

5. A method of manufacturing an insulation panel according to claim 4, wherein:

said steps of filling said cavities with said gas and enveloping said gas-filled framed assembly take place in said space filled with said gas at approximately ambient atmospheric temperature and pressure.

6. A method of manufacturing an insulation panel according to claim 1, wherein:

said gas comprises at least one of the gases in the group of heavier-than-air halogenated methanes and ethanes, which are gaseous at standard atmospheric pressure and temperature, consisting of bromochlorodifluoromethane ($CBrClF_2$) iodotrifluoreomethane ($CF_3I$), dichlorodifluoromethane ($CCl_2F_2$), and bromotrifluoromethane ($CBrF_3$).

7. A method of manufacturing an insulation panel according to claim 1, wherein:

the step of enveloping said framed assembly comprises the step of heat-sealing said envelope to thermally fuse inside surfaces thereof to hermetically seal in said gas-filled assembly.

* * * * *